United States Patent [19]

Kellner

[11] Patent Number: 4,941,341

[45] Date of Patent: Jul. 17, 1990

[54] PROCESS AND APPARATUS FOR COLD PRESSING A CONICAL EXTERNAL THREAD

[76] Inventor: Urs Kellner, Hüttenackerstrasse 10, CH-8712 Stäfa, Switzerland

[21] Appl. No.: 300,489

[22] Filed: Jan. 23, 1989

[30] Foreign Application Priority Data

Aug. 26, 1988 [CA] Canada ..... 3190/88

[51] Int. Cl.[5] ..... B21K 1/56

[52] U.S. Cl. ..... 72/402; 10/152 R

[58] Field of Search ..... 72/402, 76, 103, 104; 10/153, 152 R, 152 T

[56] References Cited

U.S. PATENT DOCUMENTS

| | | | |
|---|---|---|---|
| 228,033 | 5/1880 | Burke | 10/153 |
| 408,294 | 8/1889 | Dayton | 10/153 |
| 859,803 | 7/1907 | Cummings | 10/152 R |
| 1,466,302 | 8/1923 | Jouve | 10/153 |
| 1,712,108 | 5/1929 | Goeller | 10/153 |
| 2,160,694 | 5/1939 | Buchanan | 10/153 |
| 2,225,345 | 12/1940 | Lamoreaux | 72/402 |
| 4,689,984 | 9/1987 | Kellner | 72/402 |
| 4,751,839 | 6/1988 | Thomas | 72/402 |

*Primary Examiner*—Daniel C. Crane
*Attorney, Agent, or Firm*—Handal & Morofsky

[57] ABSTRACT

The process is carried out using a press tool which has a plurality of dies which are arranged around a longitudinal axis and are radially displaceable with respect to this axis. The radially inner surfaces of the dies correspond to segments of the conical thread to be pressed. During pressing of a conical thread in cylindrical workpiece, the dies are first drawn apart in the radial direction and the workpiece is then pushed between the dies, along a length which corresponds to only a few thread turns. The dies are then pressed toward one another in order to press into the workpiece a short conical thread in which only the first thread turn may be formed to its full depth. After the dies have been drawn apart, the workpiece is displaced between the dies through a further length which once again corresponds to only a few thread turns. When the dies are pressed toward one another again, the previously pressed thread turns are pressed deep into the workpiece and additional thread turns are formed. This process is repeated several times until the conical thread has been pressed to the predetermined total length.

16 Claims, 2 Drawing Sheets

PROCESS AND APPARATUS FOR COLD PRESSING A CONICAL EXTERNAL THREAD

Figure 1:
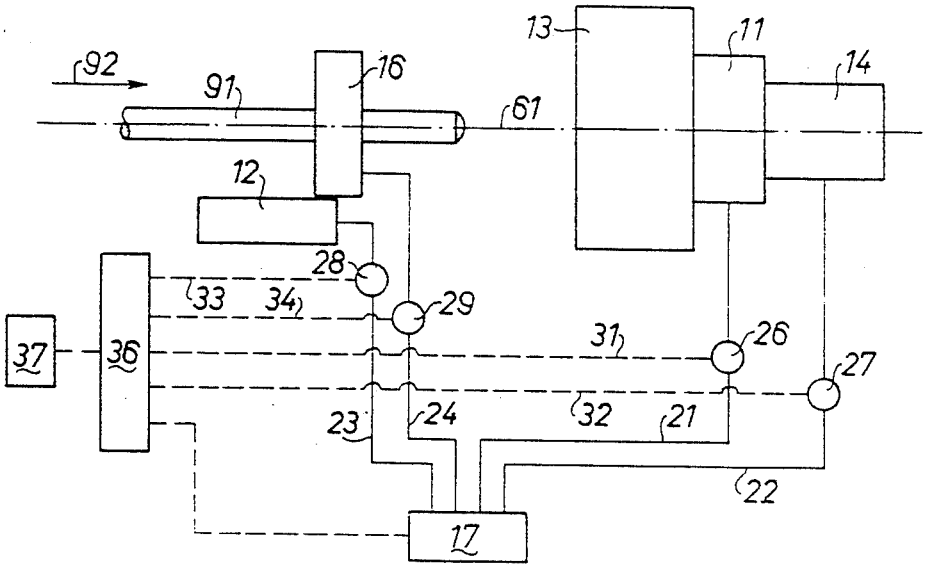

The present invention relates to a process for cold pressing a conical external thread on the one end of a virtually cylindrical workpiece, preferably of a steel reinforcement, with a press tool which has a plurality of dies which are arranged around a longitudinal axis and are displaceable at least radially with respect to this axis and whose radially inner surfaces correspond to individual segments of a nut for the thread to be pressed, and an apparatus for carrying out this process.

Conical threads make it possible to engage a large number of threads with one rotation or only a few rotations. They are therefore particularly suitable as fastening threads when, during tightening, the threaded bolt and/or the nut can be turned only with great effort or should be displaced only slightly in the axial direction.

A known use of conical threads is for the mechanical connection of ends of steel reinforcements for concrete, these ends forming butt joints with one another. The ends of the steel reinforcements are provided with conical external threads and are screwed to one another with the aid of a nut which has two opposite, conical threads.

Many different processes are known for the production of conical external threads. In the case of workpieces made of materials having relatively little toughness and hardness, for example wood screws made of aluminum, the conical external thread can be pressed directly into a cylindrical semifinished product by means of radially displaceable dies.

Workpieces made of materials having relatively great toughness and hardness, for example steel reinforcements, are usually first converted into a conical shape, after which the thread is cut into the conical surface; relatively complicated apparatuses having two chasers opposite one another are used for this purpose.

When a thread is cut, the grain flow in the workpiece is interrupted and its strength therefore reduced, and the notch effect in the region of the core of the thread undercut results in a reduction in the load-bearing cross-section of the thread; attempts have therefore also been made to roll conical threads having a high load-bearing capacity. When threads are rolled, not only are the stated disadvantages of thread-cutting avoided but the surface strengthening achieved by the rolling pressure makes it possible to produce threads which have a higher load-bearing capacity and are more hard-wearing. Apparatuses for rolling conical threads in relatively hard and tough materials require a very complicated design, for which reason such apparatuses have not been used to date, despite the advantages mentioned.

European Patent Application 85 80 810 610 (0 187 623) discloses a process for the production of a conical external thread on a workpiece made of a tough and hard material, in which the thread is cold-pressed into a conically preshaped end of a workpiece. The press tool used for carrying out this process has dies which are displaced in the axial direction in the conical inner space of a guide sleeve and pressed together or pulled apart in the radial direction. This process makes it possible to produce threads which have the advantages of non-cutting working which are described above, and the relatively light-weight, robust and simply operated apparatus requires for operation only energy sources which are available at any building site. The only disadvantage of this process or the apparatus is that the part of the workpiece in which the conical thread is to be pressed has to be conically preshaped.

The object of the present invention was therefore further to develop the above-mentioned process and the apparatus used for carrying it out, in such a way that conical threads can also be pressed in workpieces made of relatively hard and tough material without the virtually cylindrical workpiece having to be conically preshaped.

This object is achieved, according to the invention, by a process of the type stated at the outset, wherein (1) the press tool is opened by pulling apart the dies in the radial direction, (2) the press tool and the workpiece aligned with its longitudinal axis are displaced relative to one another until the dies grip a predetermined proportion of the workpiece in the longitudinal direction, (3) the dies are pressed together in the radial direction and are pressed into the workpiece until the lateral edges of their inner surfaces, which edges are parallel to the longitudinal axis, rest against one another, (4) the dies are pulled apart again and the press tool and the workpiece are rotated relative to one another about the longitudinal axis, the rotation corresponding to part of the circular sector which corresponds to the cross-section of each die, (5) process step (3) is repeated to press in any burr and (6) the press tool is rotated back to its starting position after the dies have been pulled apart in the radial direction and (7) the workpiece is removed from the press tool.

The process according to the invention has the advantage that a conical thread can be cold-pressed into a virtually cylindrical workpiece made of a hard and tough material without prior shaping of a conical surface, that only one apparatus is required for carrying out this process and that cold-pressing corresponds to a cold forging process which results in finer grains in the material and hence in an increase in its strength.

To produce relatively long conical threads, process steps (2), (3), (4), (5) and (6) are preferably repeated at least once after process step (6), and finally process step (7) is carried out.

An apparatus suitable for carrying out the process according to the invention contains a press tool having a guide sleeve, in whose conical inner space a plurality of dies are displaceably mounted along generating lines of the inner space, and a pressure plate intended for displacing the dies in the longitudinal direction of the inner space, and comprises a holding means for holding the workpiece in the longitudinal axis of the conical inner space of the guide sleeve and a feed means for displacing the holding means and/or the press tool relative to one another along the axis of the conical inner space by a preset feed distance, as well as a rotating means for rotating the holding means and/or the press tool relative to one another about the axis of the conical inner space through a preset angle.

In a preferred embodiment of this apparatus, the feed means is coordinated with a compensating cylinder which compensates a change in the workpiece length due to the axial component of the displacement of the dies and to the flow of the material during the compression process.

The process according to the invention and an apparatus suitable for carrying it out are described below with the aid of the figures.

Figure 4:
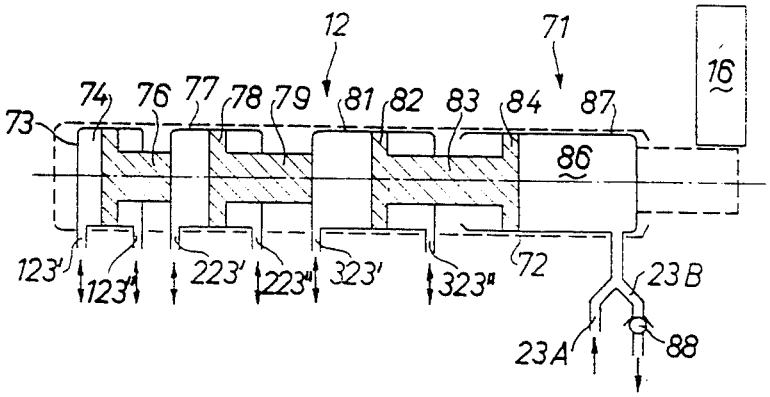
Figure 2:
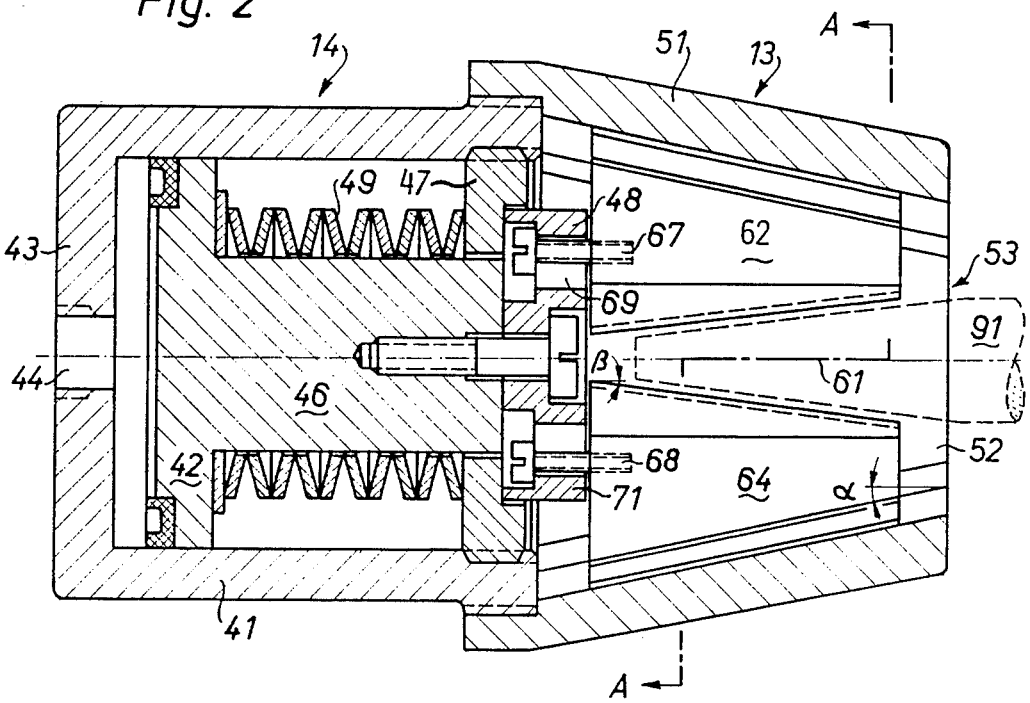
Figure 3:
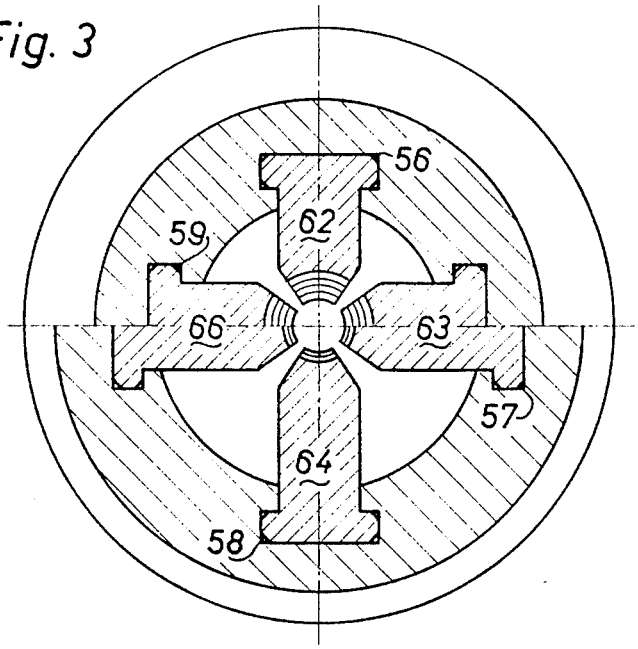

FIG. 1 shows a schematic representation of an apparatus for carrying out the process, FIG. 2 shows a longitudinal section through an embodiment of the press tool of the apparatus according to FIG. 1, FIG. 3 shows a cross-section through the press tool along the line A—A in FIG. 2 and FIG. 4 shows a preferred embodiment of the feed means and of the compensating cylinder, likewise in schematic representation.

The apparatus shown schematically in FIG. 1 contains a machine bed (not shown) on which a rotating means 11 and a feed means 12 can be fastened an adjustable distance apart. A press tool 13 is held on that side of the rotating means which faces the feed means, and a press 14 is held on the side facing away from the said feed means. A holding means 16 is arranged on the feed means 12. This holding means is intended for holding a rod-shaped workpiece 91 and is thus shown in the form of a hydraulically operated multi-jaw chuck.

The axis of rotation of the rotating means 11, the axis of symmetry of the press tool 13 and the axis of symmetry of the holding means 16 coincide with one another, so that, with a suitable distance between the press tool and the holding means, the press tool can be rotated about a rod-shaped workpiece held in the holding means.

The rotating means 11 and the press 14, and the feed means 12 and the holding means 16, are hydraulically operated and are connected via hydraulic lines 21, 22, 23 and 24 to a hydraulic unit 17. The hydraulic unit contains a hydraulic pump (not shown), which generates a constant pressure of the hydraulic fluid during operation of the apparatus. At least one electrically controllable valve 26, 27, 28 or 29, which is connected to an electronic control circuit 36 via an electric line 31, 32, 33 or 34, respectively, is arranged in each hydraulic line. The hydraulic lines 21 and 24 are arranged in pairs between the valves 27 and 29, making it possible to reverse the direction of rotation of the rotating means 11 and to open and close the holding means 16. The line 23 to the feed means consists of a plurality of parallel lines (not shown), each of which contains a valve which can be operated independently of the other valves, this being described in detail with the aid of FIG. 4. The electronic control circuit 36 can be programmed for various applications of the apparatus. Also provided is a control console 37, having a keyboard for switching on and switching off the apparatus and for setting the control circuit to a selected program.

FIG. 2 shows a longitudinal section of a press tool 13 and a press 14 intended for operating the said press tool. The press 14 contains a hydraulic cylinder 41 in which a piston 42 fits in such a way that the said piston is displaceable in the axial direction. The cylinder base 43 has a hole 44 which is provided for connection of the hydraulic line 22. A piston rod 46 is formed on that face which faces away from the working face of the piston 42, the free end of the said rod projecting out of the cylinder, through the central opening of an annular cylinder lid 47. A pressure plate 48, whose diameter is greater than the diameter of the piston rod, is fastened to the free end of the piston rod. A pressure spring 49 is located around that part of the piston rod which lies inside the cylinder, the ends of the said spring resting against the rear surface of the piston and against the inner surface of the cylinder lid.

The press tool 13 contains a guide sleeve 51 which is fastened, in the region of the cylinder lid 47, to the hydraulic press 14. The guide sleeve has a conical inner space 52 whose greatest diameter or base circle is adjacent to the pressure plate 48 and whose smallest diameter or upper circle forms an opening 53 in the upper surface of the press tool, this surface facing away from the press 14. Four grooves 56, 57, 58, 59 displaced from one another by 90° and having a T-shaped cross-section are incorporated in the wall of the conical inner space 52 (FIG. 3). The grooves run parallel to the generating lines of the conical inner space and are therefore inclined at an angle $\alpha$ to the longitudinal axis 61 of the press tool.

Four thread dies 62, 63, 64, 66 which are trapezoidal in side view are arranged in the conical inner space. The dies have a T-shaped cross-section with a two-armed guide bar and a die projecting from this. The guide bar of each die is mounted in an allocated groove in the guide sleeve in such a way that it can be displaced along the longitudinal direction of the press tool, and is connected to the pressure plate 48 by means of a screw 67, 68. The screw heads are guided in radial slots 69, 71 in the pressure plate, in order to avoid blocking the displacement in the radial direction, which displacement is superimposed on each displacement of the dies in the axial direction. The inner surfaces of the dies which face the center of the conical inner space 52 are inclined at an angle $\beta$ to the longitudinal axis 61. The direction of inclination of this angle $\beta$ is opposite to the direction of inclination of the angle $\alpha$, and the angle $\beta$ is smaller than the angle $\alpha$. The inner surfaces of the dies have an arc-shaped cross-section and have a surface profile which matches a corresponding part of a nut for the conical external thread to be pressed.

FIG. 4 shows a feed means 12 which is coordinated with a length compensating means 71. The feed means contains a housing 72 in which a plurality of piston/cylinder arrangements (in the embodiment shown, three) connected in series are installed. The first piston/cylinder arrangement consists of a first cylinder 73 which is fixed in the housing and to which the hydraulic fluid lines 123' and 123" are connected. A cylinder 77 which can be displaced in the second housing 72 is fastened to the piston rod 76 of the piston 74 sliding in the first cylinder. The hydraulic fluid lines 223' and 223" are connected to this second cylinder. A third cylinder 81 is fastened to the piston rod 79 of the piston 78 sliding in the second cylinder, hydraulic fluid lines 323' and 323" being connected to the said third cylinder. The piston 82 sliding in the third cylinder is rigidly connected to a piston 84 of the length compensating means 71 by means of a piston rod 83.

The strokes of the pistons in the three piston/cylinder arrangements differ in length, which makes it possible, by displacing one, two or all three pistons, to displace the piston 84 in the length compensation means by predetermined total lengths. The working space 86 of th length compensation means is connected via the line 23A to the hydraulic unit 17 and is filled with the hydraulic fluid at the beginning of each working cycle, so that, with each displacement of the piston 84 (toward the right in FIG. 4), the cylinder 87, which like the cylinder of the feed means is arranged so that it slides in housing 72, is displaced to the right. The cylinder 87 is mechanically connected directly or indirectly to the holding means 16 for the workpiece, so that the holding means 16 is likewise displaced according to the displacement of the cylinder 87.

A further hydraulic fluid line 23B is connected to the cylinder 87 of the length compensation means 71 or to the hydraulic fluid line 23A connected to this cylinder. This line contains a pressure relief valve 88, which opens as soon as the pressure in the working space 86 exceeds a predetermined value, as will be described in detail below.

When the apparatus according to the invention is used for cold-pressing a conical thread in a rod-like, virtually cylindrical workpiece, the "ON" button is first pressed on the control console 37, this button then activating the electronic control circuit 36 and the hydraulic unit 17. The control circuit sets the valve 27 to a first position in which hydraulic fluid flows into the cylinder 41 of the press 14 and pushes the piston 42 against the force of the spring 49 (toward the right in FIG. 2). As a result, the dies 62, 63, 64 and 65 too are displaced in the axial direction and, owing to the inclination of the guide grooves 56, 57, 58, 59 with respect to the longitudinal axis of the press tool, are simultaneously moved toward one another in the radial direction until their lateral surfaces lie against one another. At the same time, the valve 29 is also brought to a first position in which the inflowing hydraulic fluid pulls apart the holding jaws of the holding means 16 in the radial direction. The rod-like workpiece 91 can then be inserted, in the direction of the arrow 92, between the open holding jaws until it comes to rest against the dies which have been moved together.

Before the beginning of the actual working cycle, the characteristic data of the workpiece which are important for the cycle are input into the electronic control circuit with the aid of the keyboard on the control console 27, in particular the diameter of the workpiece, or the nominal diameter and the length of the conical thread to be pressed and at least one parameter relating to the material of the workpiece. The input characteristic values then determine which of a plurality of working programs stored in the control circuit is to be executed.

The working cycle begins as soon as the "START" button is pressed on the control console. In the first working step, the valve 29 is changed to a second position in which the holding jaws move toward one another until the workpiece is firmly clamped. In the second working step, the valve 27 is set to its second position, in which the cylinder 41 of the press is vented and the spring 49 draws the piston 42, together with the dies 62, 63, 64, 66 back into the rest position shown in FIG. 2. In the subsequent third working step, the valve 28 is brought to a first position, in which the hydraulic fluid flowing through displaces the feed means 12 and hence also the holding means 16 and the workpiece 91 held by the said holding means through a predetermined distance toward the press tool 13 or between the dies. In the final, fourth working step, the valve 27 is reset to its first position, in which the dies are displaced in the axial direction and at the same time are pressed together and pressed into the workpiece until their lateral surfaces rest against one another.

When the dies are pressed into the workpiece, the axial component of their displacement generates a pressure which acts on the holding means. This pressure is reinforced if the material of the workpiece flows in the direction of the greater workpiece diameter when the dies are pressed in. If this pressure exceeds a predetermined value, the pressure relief valve 88 opens and permits a backward displacement of the cylinder 87 together with the attached holding means, until the pressure of the workpiece has fallen to a tolerable value.

In the subsequent fifth working step, the valve 27 is set to the second position, with the result that the dies are once again pulled apart in the radial direction. In the next, sixth working step, the valve 26 is set to the first position, so that the rotating means 11, and with it the press 14 and the press tool, are rotated 45° to the left. In the seventh working step, the valve 27 is reset to the first position, the dies of the press tool again being moved together in the radial direction, and the burr, which forms during pressing of the conical thread in the region of the lateral edges of the dies, is pressed out. In the eighth working step, by activation of the valves 27 and 26, first the dies are pulled apart again and then the press tool is rotated 45° to the right, into its starting position. The workpiece with a cold-pressed conical thread can then be removed from the apparatus.

Workpieces having large diameters and/or made of a relatively tough material, or conical threads having more than, for example, five thread turns, are advantageously pressed in a plurality of working cycles. In the second and each subsequent working cycle, the dies remain in the pressing position after the fourth working step described above, while in a first intermediate working step the valve 24 is set to the first position and the holding jaws of the holding means 16 are thus moved apart. In a second intermediate working step, the valve 28 is set to the second position, and the feed means 12 is thus reset to its starting position. Thereafter, each first, second, third and fourth working step described above is repeated, i.e. the holding jaws are moved toward one another, the dies are drawn back to the rest position, the workpiece is inserted a predetermined length deeper into the press tool by displacement of the feed means, and the dies are pressed together again.

A working cycle is always terminated by the working steps six and seven described above, by means of which the burr, which is unavoidable when pressing the conical thread, is pressed into the workpiece.

When a thread is pressed in a plurality of working cycles, the workpiece is inserted more deeply into the press tool for each working cycle. Thus, the previously pressed thread turns are further pressed, and new thread turns are pressed in. In order to limit the overall deformation of the workpiece in the region of the thread, which deformation increases with increasing number of work cycles, it may be advantageous to adjust the feed of the workpiece into the press tool in each subsequent work cycle in such a way that it is somewhat shorter than in the preceding work cycle.

When the apparatus according to the invention was tested in practice, conical threads were pressed into steel reinforcements. Each steel reinforcement had a diameter of 40 mm. The conical thread had a cone angle of 6°, a lead of 4 mm and a flank angle of 90°, corresponding to a thread depth of 2 mm or half the lead. The press tool used contained four dies, each of which had a cross-section corresponding to a quadrant of a circle when viewed in the axial direction. The pressure of the press was up to 650 bar in the axial direction, with the result that the dies reached a compressive pressure of up to 850 tonnes in the radial direction.

To cold-press a conical thread with 15 thread turns, five work cycles were carried out, the feed of the steel reinforcement into the press tool corresponding to the (axial) length of five thread turns during the first cycle and to the length of four, three or two thread turns or one thread turn, respectively, in the second to fifth cycles. The total working time was about 90 sec. The completely pressed conical thread showed neither fragmentation nor a burr.

The apparatus described can of course be modified in a variety of ways and adapted to specific requirements. For example, instead of a press which is displaced hydraulically into the working position and by means of a spring into the rest position, it is possible to use a press which is displaced hydraulically in both directions. Furthermore, it is possible to use a feed means having only one cylinder, whose displacement is controlled by the amount of hydraulic fluid introduced. In a feed means having only one cylinder, the pressure relief valve 88 can also be connected to this cylinder, and the length compensation means can thus be dispensed with.

The apparatus can be composed of typical commercial components and assemblies, and it is assumed that the electronic control and hydraulic unit for controlling or actuating the individual means are familiar to any skilled worker, so that a detailed description of these means is dispensed with.

I claim:

1. A process for cold-pressing a conical external thread having a cone angle of 6° on an end of a virtually cylindrical blunt-ended workpiece, preferably a steel reinforcement, by means of a press tool which has a plurality of dies, having radially inner surfaces with lateral edges, said dies being arranged around a longitudinal axis and displaceable radially with respect to this axis and said radially inner surfaces correspond to individual segments of a nut for the thread to be pressed, wherein (1) the press tool is opened by pulling apart the dies in the radial direction, (2) the press tool and the workpiece, aligned with said longitudinal axis, are displaced relative to one another by five times the lead of the coincal thread until the dies grip a predetermined proportion of the workpiece in the longitudinal direction, (3) the dies are pressed together in the radial direction and are pressed into the workpiece until said lateral edges of said inner surfaces, which edges are parallel to the longitudinal axis, rest against one another, (4) the dies are pulled apart again and the press tool and the workpiece are rotated relative to one another about the longitudinal axis, the rotation corresponding to part of the circular sector which corresponds to the cross-section of each die, (5) process step (3) is repeated to press in any burr and (6) the press tool is rotated back to its starting position after the dies have been pulled apart in the radial direction whereupon (7) said workpiece is removed from the press tool.

2. A process as claimed in claim 1, wherein, after the dies have been drawn apart and the press tool rotates back to it starting position in process step (6), process steps (2), (3), (4), (5) and (6) are repeated at least once and finally process step (7) is carried out wherein the longitudinal displacement in step (2) is increased for each repetition.

3. A process as claimed in claim 1, wherein, when process step (2) is repeated, the magnitude of the displacement corresponds to the lead of the conical thread or of an integral multiple thereof.

4. A process as claimed in claim 1, wherein the length of the relative displacement of press tool and workpiece becomes smaller with increasing repetition of the process steps (2), (3), (4), (5) and (6).

5. Apparatus for cold pressing a conical external thread on the end of a cylindrical workpiece through multiple pressing steps comprising:

(a) a press tool having a guide sleeve defining a conical inner space having a longitudinal axis, (b) a plurality of dies, having radially inner surfaces with lateral edges, displaceably mounted along generating lines of said inner space, (c) a pressure plate fastened to said dies and movable in the longitudinal direction of the inner space, said dies fastened to said pressure plate in a manner allowing radial movement of said dies and said radial movement bounded by said guide sleeve and said dies lateral edges;

(d) holding means for holding a workpiece in said longitudinal axis of said conical inner space of said guide sleeve;

(e) feed means, for displacing said holding means and the press tool relative to one another along said longitudinal axis of said conical inner space through at least one presettable distance;

(f) rotating means for rotating said press tool about said longitudinal axis of said conical inner space through a presettable angle, and (g) control means for causing said feed means to move said workpiece into said conical inner space while said dies are radially displaced, causing said dies to move radially inward until said lateral edges meet whereby said workpiece is pressed, causing said dies to be retracted from said workpiece, causing said rotating means to rotate said press tool through said presettable angle and causing said dies to again press said workpiece whereby any burr resulting from the previous pressing is pressed.

6. Apparatus as claimed in claim 5, wherein said feed means interacts with a means for compensating a workpiece displacement due to the axial component of the displacement of said dies and to the flow of the material of said workpiece.

7. Apparatus as claimed in claim 5, wherein said feed means has a plurality of sections which can be activated independently of one another wherein each of said sections is provided for a different feed distance.

8. Apparatus as claimed in claim 5, wherein a hydraulic unit is provided said hydraulic unit being connected through hydraulic lines containing valves to said press tool, said holding means, said feed means and said rotating means.

9. Apparatus as claimed in claim 8, wherein an electronic control circuit is also provided which controls said valves in said hydraulic lines in conformity with an input program.

10. Apparatus as claimed in claim 9 which comprises an electronic control console having a keyboard for manually inputting the characteristic data required for the conical thread to be pressed.

11. Apparatus for cold pressing a conical external thread on an end of a cylindrical workpiece comprising:

(a) a press tool with an inner wall defining a conical interior volume having a longitudinal axis wherein a plurality of dies are axially, displaceably positioned along said inner wall;

(b) a press coaxial with, and attached to, said press tool and communicating with the base side of said conical interior, comprising:
(i) a cylinder, coaxial with said press tool;
(ii) a piston within said cylinder; and
(iii) a pressure plate attached to said cylinder;
(c) fastening means to connect said pressure plate with said dies;
(d) press means communicating with said piston within said cylinder and capable moving said piston;
(e) holding means to secure said workpiece, such that said workpiece is coaxial with said press tool;
(f) feed means, attached to said holding means, to move said holding means, and said workpiece, with respect to said press tool, along said longitudinal axis, through a preset distance;
(g) rotating means connected to said press tool and press combination to enable rotation of said combination around said longitudinal axis; and
(h) a hydraulic unit communicating separately with said press means, said holding means, said feed means and said rotating means.

12. An apparatus as in claim 11 further comprising a cylinder lid separating said press tool from said press.

13. An apparatus as in claim 12 further comprising a spring biased between said piston and said cylinder lid.

14. A process for cold-pressing a conical external thread on an end of a virtually cylindrical blunt-ended workpiece, preferably a steel reinforcement, by means of a press tool which as plurality of dies having radially inner surfaces with lateral edges, said dies being arranged around a longitudinal axis and displaceable radially with respect to this axis and said radially inner surfaces correspond to individual segments of a nut for the thread to be pressed, wherein
(1) the press tool is opened by pulling apart the dies in the radial direction,
(2) the press tool and the workpiece, aligned with said longitudinal axis, are displaced relative to one another until the dies grip a predetermined proportion of the workpiece in the longitudinal direction,
(3) the dies are pressed together in the radial direction and are pressed into the workpiece until said lateral edges of said inner surfaces, which edges are parallel to the longitudinal axis, rest against one another,
(4) the dies are pulled apart again and the press tool and the workpiece are rotated relative to one another about the longitudinal axis, the rotation corresponding to part of the circular sector which corresponds to the cross-section of each die,
(5) process step (3) is repeated to press in any burr,
(6) the press tool is rotated back to its starting position after the dies have been pulled apart in the radial direction wherein, after the dies have been drawn apart and the press tool rotates back to its starting position in process step (6), process steps (2), (3), (4), (5) and (6) are repeated at least once, wherein the longitudinal displacement in step (2) is increased with each repetition, and
(7) the workpiece is removed from the press tool.

15. A process as claimed in claim 14, wherein the relative displacement of press tool and workpiece corresponds to a work length at which the first thread turn is pressed out with a full profile.

16. A process as claimed in claim 14, wherein, for a press tool having four dies, the press tool and the workpiece are rotated 45° relative to one another about the longitudinal axis in working steps (4) and (6).

* * * * *